US005942715A

United States Patent [19]

Denchfield et al.

[11] Patent Number: 5,942,715

[45] Date of Patent: Aug. 24, 1999

[54] WEAPON SIMULATOR

[75] Inventors: Clifford Denchfield, Ellington; Paul Gledhill, Knebworth, both of United Kingdom

[73] Assignee: Lockheed Martin Tactical Systems U.K. Limited, Hertfordshire, United Kingdom

[21] Appl. No.: 08/930,081

[22] PCT Filed: May 8, 1996

[86] PCT No.: PCT/GB96/01089

§ 371 Date: Feb. 23, 1998

§ 102(e) Date: Feb. 23, 1998

[87] PCT Pub. No.: WO96/35918

PCT Pub. Date: Nov. 14, 1996

[30] Foreign Application Priority Data

May 10, 1995 [GB] United Kingdom ..... 9509490

[51] Int. Cl.[6] ..... F41A 33/00

[52] U.S. Cl. ..... 89/7; 42/55; 102/702; 434/16

[58] Field of Search ..... 434/11, 16, 12; 89/7; 124/56, 57, 60, 61, 63, 64, 67, 75; 446/398, 401, 405, 406

[56] References Cited

U.S. PATENT DOCUMENTS

| | | | |
|---|---|---|---|
| 3,595,436 | 7/1971 | Ohlund | 222/4 |
| 4,245,403 | 1/1981 | Hipp | 434/11 |
| 4,416,630 | 11/1983 | Hagen | 434/16 |
| 4,818,843 | 4/1989 | Swiatosz | 392/397 |
| 5,180,878 | 1/1993 | Denchfield | 89/7 |
| 5,233,927 | 8/1993 | Wulvik | 102/334 |
| 5,511,978 | 4/1996 | Sellers | 434/11 |

*Primary Examiner*—Robert A. Hafer

*Attorney, Agent, or Firm*—Townsend and Townsend and Crew

[57] ABSTRACT

The invention provides a weapon simulator which comprises a combustion chamber having an exhaust port, a mechanism for admitting fuel gas to the combustion chamber, an ignition system for igniting fuel gas in the combustion chamber to cause an explosion, and an outlet valve to close the exhaust port. The outlet valve is arranged to open rapidly and with audible results in response to an explosive pressure rise within the combustion chamber. Further, the outlet valve comprises a collapsible diaphragm and a breechblock having opposing clamping parts releasable secured together and which releasably grip the collapsible diaphragm such that the gripped portion of the diaphragm is released on its collapse due to the explosive pressure rise in the combustion chamber.

10 Claims, 3 Drawing Sheets

WEAPON SIMULATOR

TECHNICAL FIELD

The invention relates to a weapon simulator for use for example in gunnery or weapons training to simulate the sound of gunfire.

BACKGROUND ART

It is known to provide gunfire simulators which simulate the flash and noise of a gun being fired or the strike of an explosive projectile. At their simplest such gunfire simulators may be no more than blank cartridges which directly take the place of live ammunition. However for use in simulating the firing of battlefield weapons from small arms through missile launchers to heavy guns such as tank guns and field artillery it is known to provide pyrotechnic devices which are housed in a metal block which may, for example, hold 12,20 or 24 rounds and which is fixed to the exterior of the weapon platform close to the barrel of the weapon in question. Usually the weight of such devices is such that they cannot be fixed directly to the barrel of the weapon. Often the devices are sufficiently bulky to create an obstruction to the sight of the tank or gun crew. Since such devices are limited to a relatively small number of rounds, a lack of realism can result. Also the cost of the pyrotechnic devices, while being much less than that of live ammunition, is nevertheless appreciable.

Our U.K. patent GB-B-2250333 discloses a gunfire simulator intended to address these problems and comprising a combustion chamber, means for admitting fuel gas to the combustion chamber, a flap valve for admitting air to the combustion chamber, means to force ambient air into the combustion chamber through the flap valve, ignition means for igniting fuel gas in the combustion chamber to cause an explosion, an exhaust port in the combustion chamber and outlet valve means for closing the exhaust port and arranged to open rapidly and with audible results in response to explosive pressure rise within the combustion chamber. Outlet valve means comprising a frangible diaphragm is specifically disclosed.

In the gunfire simulator disclosed in U.K. patent GB-B-2250333, the diaphragm may be part of a web, tape or ribbon of the thin sheet extending across the exhaust port and which is movable to position a fresh section of the sheet to close the exhaust port between one explosion and the next, and the simulator comprises means for feeding a fresh section of the web to the exhaust port after each explosion, and an automatic breechblock mechanism for releasably clamping a fresh section of the sheet in position during each explosion.

It is an object of the invention to provide a novel gunfire simulator of the same general kind as is disclosed in our U.K. patent GB-B-2250333.

DISCLOSURE OF INVENTION

From one aspect the invention is a weapon simulator of the kind comprising a combustion chamber, means for admitting fuel gas to the combustion chamber, ignition means for igniting fuel gas in the combustion chamber to cause an explosion, an exhaust port in the combustion chamber and outlet valve means for closing the exhaust port and arranged to open rapidly and with audible results in response to explosive pressure rise within the combustion chamber, wherein the outlet valve means comprises a collapsible diaphragm and comprising a breechblock mechanism for releasably gripping the diaphragm whereby at least the gripped portion of the diaphragm is released on its collapse due to the explosive pressure rise in the combustion chamber. The collapsible diaphragm may be disc-like and conveniently the breechblock mechanism may be arranged to engage and grip the peripheral edge of the diaphragm. Thus it is intended that no part of the diaphragm remains in the breechblock mechanism after firing. This is particularly useful in a single shot simulator where the diaphragm is discrete and is replaced between firings e.g. manually, as compared to the automatic multifire simulator disclosed in U.K. patent GB-B-2250333 in which the diaphragm is frangible and is formed by a web, tape or ribbon, since the release of the diaphragm intact prevents jamming of the breechblock mechanism which we found tended to occur in a single shot simulator operating using a frangible diaphragm due, we believe, to the distortion of a part of the diaphragm remaining in the breech after firing.

The breechblock mechanism may comprise two opposed clamping parts, releasably secured together e.g. by screw-threaded means. Preferably the breechblock mechanism comprises stop means for ensuring that the two parts are secured together to clamp a diaphragm therebetween to a predetermined extent. This may be achieved by utilizing a bayonet coupling in place of the screw-threaded means.

Preferably the opposed clamping parts of the breechblock mechanism comprise means for resiliently clamping the peripheral edge of the diaphragm. Thus, one of the opposed clamping members may comprise an elastomeric clamping part.

The collapsible diaphragm for use in the weapon simulator may comprise a sheet of dimensionally stable material, e.g. stiff plastics or cardboard. Preferably the diaphragm is disc-like.

As indicated above the collapsible diaphragm is constructed such that in use it collapses, that is to say, it deforms due to pressure rise in the combustion chamber such that it is released intact by the breechblock mechanism, at least to the extent that no part of the diaphragm is retained by the breechblock mechanism after firing. It is important that the material of the diaphragm is chosen to be dimensionally stable such that its deformation does not cause the diaphragm to stretch to any significant extent since this might hinder or prevent the intact release of the diaphragm.

In some cases, e.g. if it is desired to modify the level of sound generated by the simulator, it might be desirable to provide the diaphragm with a portion, preferably centrally disposed, of reduced thickness and which may be frangible. Thus the diaphragm may comprise a main disc-like body adapted to be gripped by its periphery in the breechblock mechanism of the simulator, the main body being formed centrally with a circular aperture covered by a frangible membrane secured to the main body, e.g. by means of an adhesive.

The diaphragm may carry a frangible or otherwise rupturable receptacle e.g. of thin plastics sheet or foil containing a powder intended to simulate smoke associated with gunfire, the receptacle being arranged to discharge the powder when the diaphragm collapses. We have found that finely divided magnesium carbonate powder is suitable for this purpose. The receptacle may be in the form of a thermoformed plastics dish or tray secured by its peripheral lip to the diaphragm e.g. by means of an adhesive, so that the diaphragm closes the receptacle.

An alternative form of smoke simulating diaphragm may comprise a pair of discs at least one of which is frangible connected at their edges to the opposed axial ends of an axially short annular, e.g. cylindrical body to form an enclosure for the smoke simulating powder.

BRIEF DESCRIPTION OF DRAWINGS

The invention is diagrammatically illustrated, by way of example in the accompanying drawings in which.

BEST MODE FOR CARRYING OUT THE INVENTION

Figure 1:
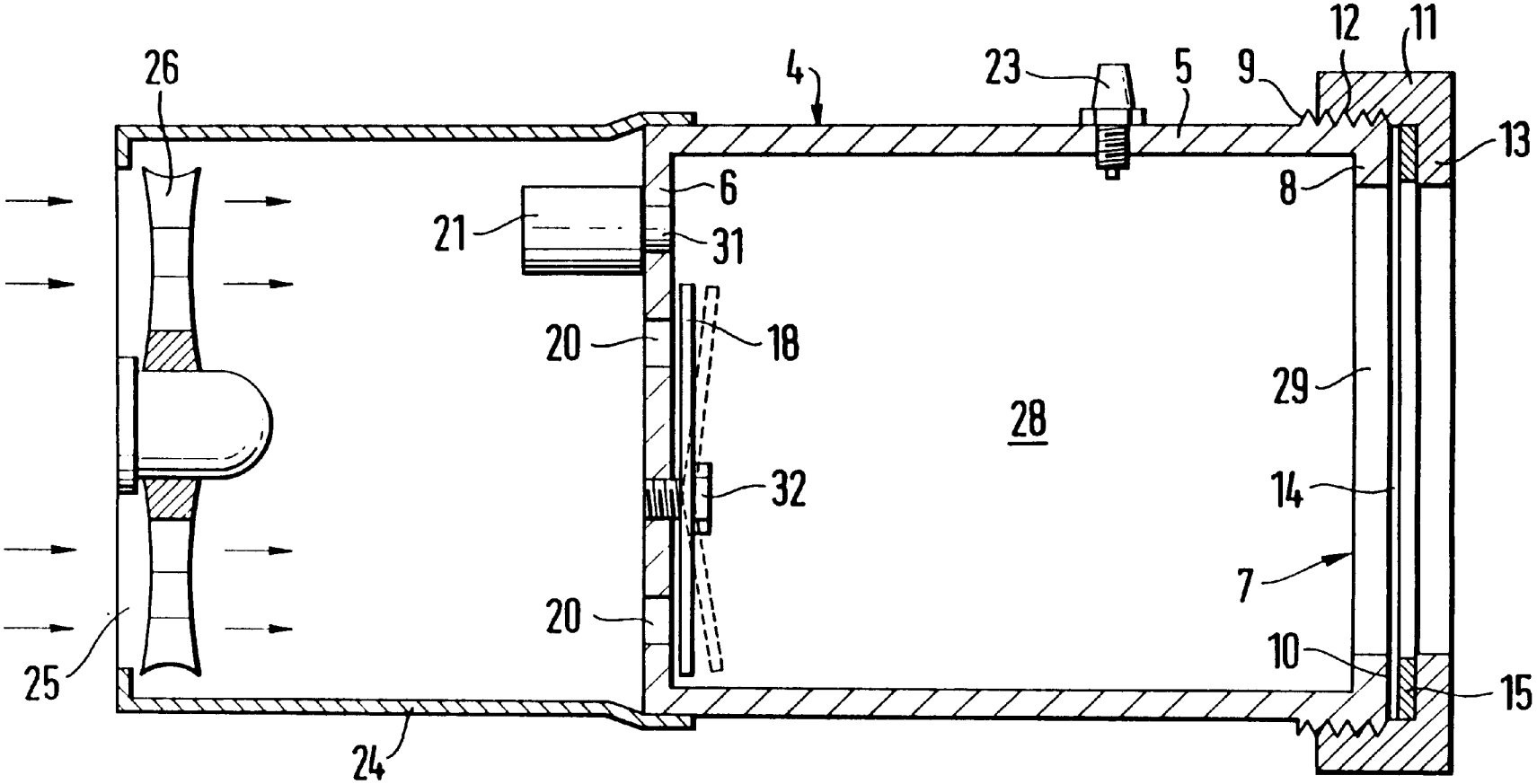
FIG. 1 is a cross-sectional side elevation of a single shot weapon simulator.

FIG. 1 of the drawings illustrates a single shot breechblock mechanism for a gunfire or weapon simulator generally of the kind described in our U.K. patent GB-B-2250333. In FIG. 1 a gunfire simulator 4 intended for use in battlefield weapons training comprises a generally cylindrical combustion chamber 28 defined by a cylindrical wall 5 bounded at one end by an end wall 6. The cylindrical wall 5 carries a spark plug 23 which projects into the chamber 28. Although not shown in the drawing, the electrodes of the spark plug preferably extend into the combustion chamber so that ignition occurs centrally. The end wall 6 carries a gas solenoid valve 21 which communicates with the interior of the chamber 28 through an inlet port 31. The end wall 6 is also formed with air inlet ports 20 which communicate between atmosphere and the chamber 28. The ports 20 are controlled by a flap valve 18 disposed within the chamber 28 adjacent to the end wall 6 and in the form of a resilient disc of a material such as synthetic rubber clamped to the wall 6 by fastening means 32 to close the ports 20 as shown in full lines, but capable of resilient deflection into the position shown in dotted lines to allow air into the combustion chamber.

The end 7 of the combustion chamber opposite to end wall 6 carries an inwardly projecting flange 8 which defines a circular aperture 29 which acts as an exhaust port communicating between the combustion chamber and atmosphere. The flange 8 also defines an axial end face 10. The end 7 of the combustion chamber is formed externally with screw threads 9. An annular member 11 is formed with internal screw threads 12 for mating engagement with the external screw threads 9 on the end 7 of the combustion chamber whereby the annular member 11 can be removably secured on the end of the combustion chamber to form a breechblock mechanism.

As an alternative to the screw-threaded engagement the annular member 11 may be releasably coupled to the end 7 of the combustion chamber by means of a bayonet coupling known per se. This will have the beneficial effect of providing positive stop means for preventing unintentional overtightening of the breechblock, which may occur with a screw-threaded breechblock.

The annular member 11 is formed at one end with an inwardly projecting flange 13 corresponding in diameter to that of the flange 8 of the combustion chamber. A disc-like collapsible diaphragm 14 described more fully below is shown releasably clamped between the end face 10 of the combustion chamber and the flange 13 of the annular member 11, with the interposition of a resilient ring 15 between the diaphragm 14 and the flange 13 of the annular member 11 for the purpose appearing below.

The end 6 of the combustion chamber is continued rearwardly by a generally cylindrical housing 24 formed with an open end 25 in which is mounted a fan or a blower 26 which is used to force air into the combustion chamber via the inlet ports 20.

In operation of the simulator device, fuel gas, e.g. a mixture of propane and butane, is admitted to the combustion chamber 28 through the gas valve 21 and combustion air is blown into the combustion chamber through the ports 20 by the fan 26, during which period the flap valve 18 deforms into the position shown in dotted lines. The fuel/air mixture is then ignited by means of the spark plug 23 so that pressure within the combustion chamber rises rapidly. This rise in pressure causes the inlet valve 18 to close, i. e. assume the position shown in full lines. When the pressure reaches a given level the diaphragm 14 will collapse and in collapsing will become detached from the breechblock to allow the combustion gases to escape through the exhaust port 29 thus causing the characteristic flash and bang of a fired weapon or explosive strike. The diaphragm, which acts as an exhaust valve, releases as quickly as possible to give a sharp report. The fan or blower 26 preferably operates continuously so that when the pressure in the chamber 28 drops, the inlet valve 18 opens so that air is admitted to the combustion chamber to purge the exhaust gases via the open exhaust port.

As indicated above, the annular ring member 11 and the end 10 of the combustion chamber together form a breechblock mechanism for releasably clamping the disc-like diaphragm 14, which forms outlet valve means to close the combustion chamber. This is achieved by resiliently clamping the peripheral edge of the diaphragm 14 between the opposed pair of flanges 8 and 13 with the interposition of the elastic ring 15 so that the diaphragm is expelled intact from the combustion chamber when an adequate pressure rise takes place, caused by the explosive combustion of a fuel/air mixture. In a preferred implementation, the elastic ring 15 is of neoprene rubber and the threaded clamp ring 11 is tightened against a mechanical stop to control the compression force on the elastic ring 15. When explosive combustion takes place in the chamber, the sudden rise in internal pressure causes the diaphragm to deform sufficiently to be released by the clamping mechanism formed by the threaded ring, the elastic ring 15 and the rim 10 of the combustion chamber, so that the diaphragm is expelled from the combustion device intact and in doing so generates the desired noise effect.

Figure 2:
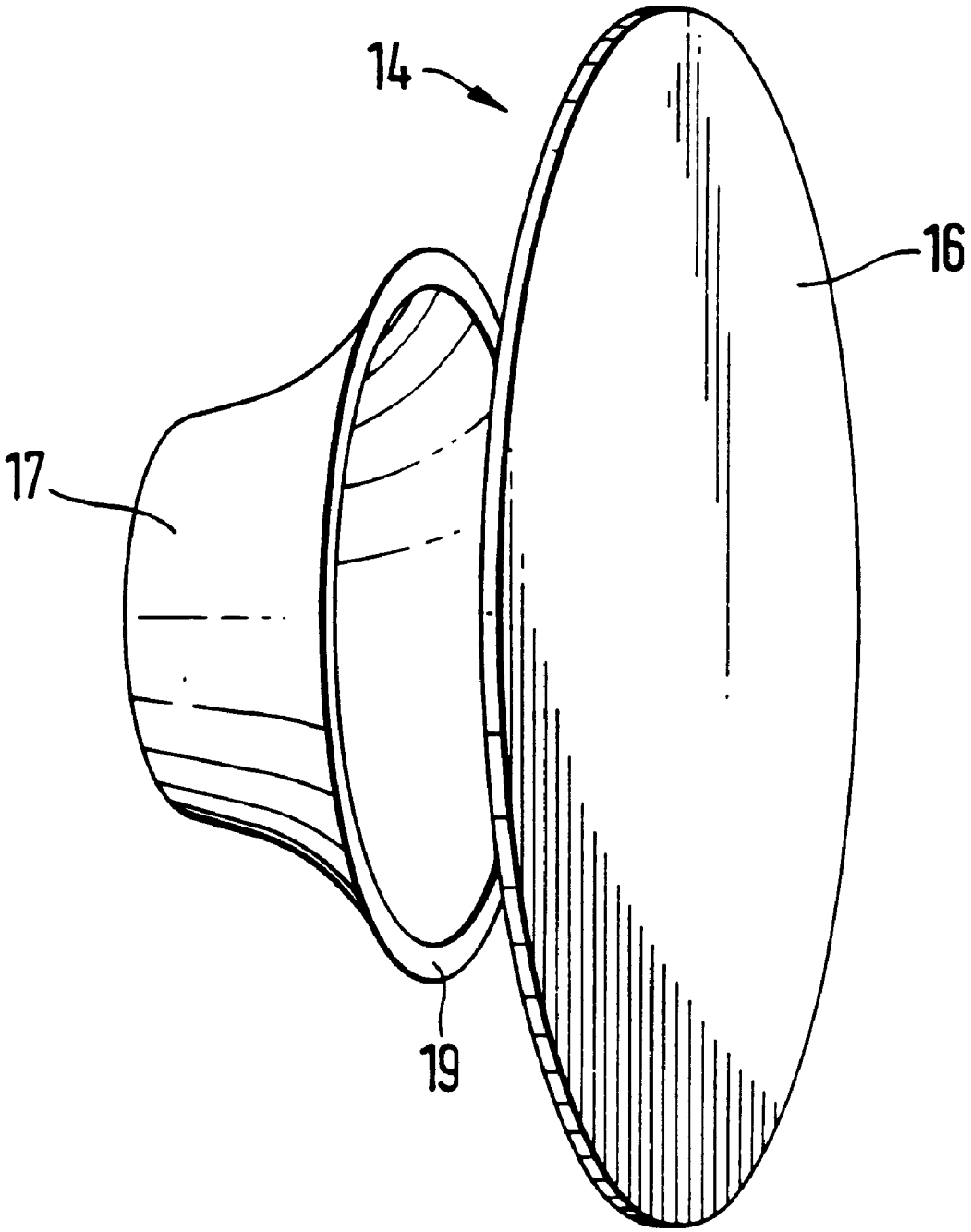
FIG. 2 is an exploded perspective view of an embodiment of diaphragm for a weapon simulator of the kind shown in FIG. 1, and incorporating smoke simulating means.

As shown in FIG. 2, a diaphragm 14, suitable for the breech block mechanism of FIG. 1 is formed by a single disc 16 of a material such as paper, plastics or card. The volume of the generated sound, and its acoustic spectrum, are variable by modification of the diaphragm geometry and materials and by variation of the diaphragm deforming pressure wave characteristics. Furthermore, the diaphragm may be treated to be proof against moisture or to biodegrade in a controlled manner. Thus the diaphragm may be coated e.g. with varnish.

FIG. 2 also illustrates a means for the production of a smoke effect, conventionally produced by pyrotechnic means and used in conjunction with weapon firing and hit simulation. The means comprises a rupturable dish-like container 17, e.g. of frangible thin plastics sheet sealed by its peripheral edge 19 to the centre of the diaphragm 16 e.g.

with the aid of an adhesive and containing the material which is to form the simulated smoke cloud, e.g. magnesium carbonate powder. In use the diaphragm 14 is positioned in the breechblock such that the container 17 is disposed within the combustion chamber 28.

When the diaphragm 14 is expelled from the simulator the container is ruptured, or at least is detached from the disc 16, to discharge the smoke material forth to create the effect of a smoke cloud. The volume, density and colour of the simulated smoke cloud are all variable by modification of the smoke material, the geometry of the diaphragm 14 and the rupturing pressure wave characteristics of the simulator.

Figure 3:
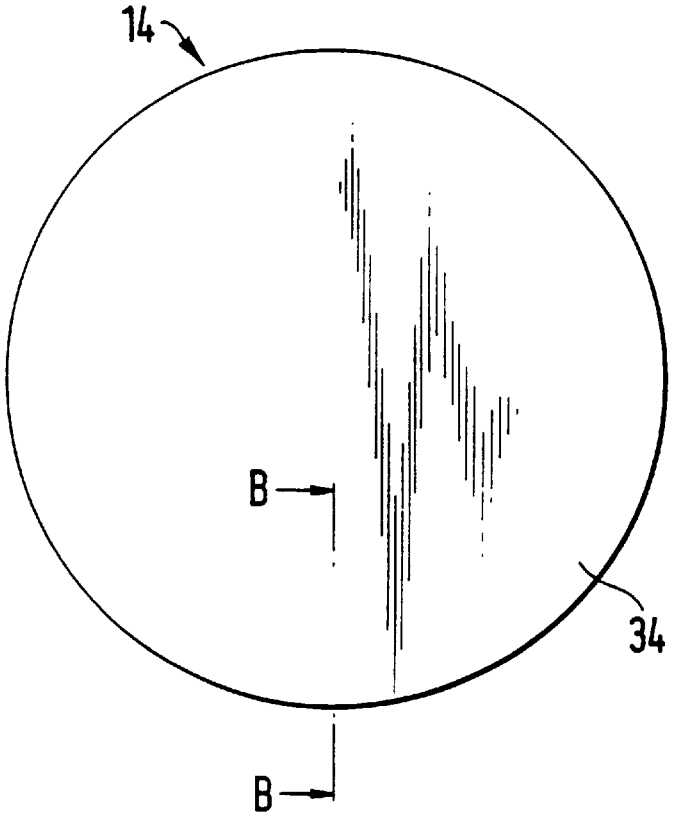
FIG. 3 is a plan view of another embodiment of smoke simulating diaphragm.
Figure 4:
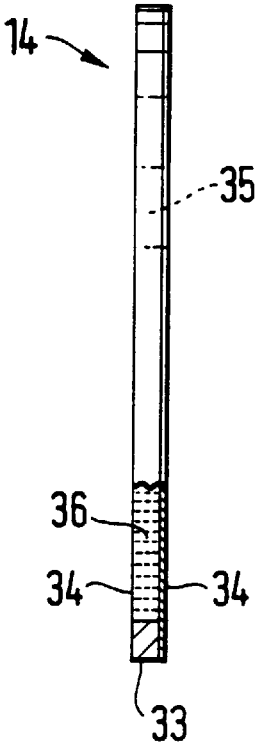
FIG. 4 is a partly sectioned side view taken on the line B—B of FIG. 3.

In FIGS. 3 and 4 there is shown further embodiment of smoke simulating diaphragm 14 which operates in a generally simular manner to that of FIG. 2. The construction consists of a cardboard cylindrical annulus 33 having an axial length of 4 to $5_{mm}$ varnished on its exterior surface and sandwiched between two $0.58_{mm}$ thick frangible discs 34 of Grade K tan shade calendered pressboard. The internal surfaces may be coated with a heat sensitive adhesive and the external surfaces may be coated with red dyed varnish, in the interests of visibility. The cavity 35 formed by the sandwich construction can be partly filled with magnesium carbonate/oxide powder 36 e.g. 3*g*.

The advantage of this embodiment of smoke diaphragm is the possibility of improved smoke simulation and also to permit an easily/speedily loadable diaphragm for multi-shot gunfire simulators, although it is envisaged that it could also be used for the single shot breech mechanism of FIG. 1.

INDUSTRIAL APPLICABILITY

The invention thus provides a novel gunfire simulator.

We claim:

1. A weapon simulator of the kind comprising a combustion chamber, means for admitting fuel gas to the combustion chamber, ignition means for igniting fuel gas in the combustion chamber to cause an explosion, an exhaust port in the combustion chamber and outlet valve means for closing the exhaust port and arranged to open rapidly and with audible results in response to explosive pressure rise within the combustion chamber, characterized in that the outlet valve means comprises a collapsible diaphragm and by a breechblock for releasably gripping the collapsible diaphragm such that the gripped portion of the diaphragm is released on its collapse due to the explosive pressure rise in the combustion chamber, the breechblock comprising opposed clamping parts which are releasably secured together.

2. A weapon simulator according to claim 1, characterized in that the breechblock comprises positive stop means for ensuring that the opposed clamping parts are secured together to a predetermined extent to clamp a collapsible diaphragm therebetween.

3. A weapon simulator according to claim 1, characterized in that the opposed clamping parts comprise means for resiliently clamping the diaphragm.

4. A weapon simulator according to claim 3, characterized in that the opposed clamping parts comprise an elastomeric clamping part.

5. A weapon simulator according to claim 1, characterized in that the diaphragm, comprises a disc of a dimensionally stable material.

6. A weapon simulator according to claim 1, characterized in that the collapsible diaphragm comprises a receptacle containing a powder to simulate smoke associated with weaponry, the receptacle being adapted to discharge the powder when the diaphragm collapses.

7. A weapon simulator according to claim 6, characterized in that the powder is finely divided magnesium carbonate.

8. A weapon simulator according to claim 6, characterized in that the receptacle comprises a dish formed from sheet material and sealed to the disc whereby the disc closes the receptacle.

9. A weapon simulator according to claim 6, characterized in that the collapsible diaphragm comprises a spaced pair of discs at least one of which is frangible, the discs being connected at their margins to the opposed axial ends of a cylindrical body to form the receptacle.

10. A weapon simulator comprising:

a combustion chamber having an exhaust port;

means for admitting fuel gas to the combustion chamber;

ignition means for igniting fuel gas in the combustion chamber to cause an explosion;

an outlet valve to close the exhaust port, the outlet valve being arranged to open rapidly and with audible results in response to an explosive pressure rise within the combustion chamber, wherein the outlet valve comprises a collapsible diaphragm and a breechblock having opposing clamping parts releasable secured together and which releasably grip the collapsible diaphragm such that the gripped portion of the diaphragm is released on its collapse due to the explosive pressure rise in the combustion chamber.

* * * * *